US008881570B2

(12) United States Patent
Hansen

(10) Patent No.: US 8,881,570 B2
(45) Date of Patent: Nov. 11, 2014

(54) PRESS

(75) Inventor: Martin Hansen, Skanderborg (DK)

(73) Assignee: Kiermar Technology Holding ApS, Skanderborg (DK)

( * ) Notice: Subject to any disclaimer, the term of this patent is extended or adjusted under 35 U.S.C. 154(b) by 875 days.

(21) Appl. No.: 13/125,093

(22) PCT Filed: Oct. 15, 2009

(86) PCT No.: PCT/DK2009/050273

§ 371 (c)(1),
(2), (4) Date: Apr. 20, 2011

(87) PCT Pub. No.: WO2010/045947

PCT Pub. Date: Apr. 29, 2010

(65) Prior Publication Data

US 2011/0203432 A1 Aug. 25, 2011

(30) Foreign Application Priority Data

Oct. 20, 2008 (DK) ..... 2008 01454

(51) Int. Cl.
*B21D 45/02* (2006.01)

(52) U.S. Cl.
CPC ..... *B21D 45/02* (2013.01)
USPC ..... 72/344; 72/418; 72/427

(58) Field of Classification Search
CPC ..... B21D 45/00; B21D 45/003; B21D 45/02; B21D 45/04
USPC ..... 72/344, 345, 346, 417, 418, 419, 420, 72/421, 426, 427, 428, 455; 100/218; 198/750.1
See application file for complete search history.

(56) References Cited

U.S. PATENT DOCUMENTS 3,918,280 A * 11/1975 Davis ..... 72/20.5
4,078,461 A * 3/1978 Ohta ..... 83/111

(Continued)

FOREIGN PATENT DOCUMENTS

CN 201195411 2/2009
EP 1240999 9/2002

(Continued)

*Primary Examiner* — Edward Tolan
(74) *Attorney, Agent, or Firm* — James Creighton Wray

(57) ABSTRACT

A press (1) including: —a frame (2); —a first press bed (3) with a first tool part (4), wherein the first press bed (3) is provided between the frame (2) and the first tool part (4); —first displacement means (5); —a second press bed (6) with a second tool part (7) which in use is arranged at a position opposite to the first tool part (4), and where the second press bed (6) is provided between the frame (2) and the second tool part (7); —a device (8) for introducing workpieces (9) between the first (4) and the second tool parts (7); —a device (10) for ejecting finished workpieces (9'); —a punch (11) which is vertically displaceable through coaxial openings (13, 14) between the first tool part (4) and the second tool part (7); —a punch cylinder (15) for displacing the punch (11), wherein the press furthermore includes second displacement means (16) which are connected between the frame (2) and the second tool part (7) for horizontal displacement of the second tool part (7) between a pressing position with the openings (13, 14) aligned, and an ejecting position with the opening (14) of the second tool part outside the press beds (3, 6), and that the first displacement means (5) are connected between the frame (2) and the first press bed (3), where the first press bed (3) is vertically displaceable, and where the second press bed (6) is fastened to the frame (2), or that the first displacement means (5) are connected between the frame (2) and the second press bed (6), where the second press bed (6) is vertically displaceable, and where the first press bed (3) is fastened to the frame (2).

12 Claims, 13 Drawing Sheets

(56) References Cited

U.S. PATENT DOCUMENTS

| | | | | | |
|---|---|---|---|---|---|
| 4,203,314 | A | * | 5/1980 | Vandlik et al. | 72/427 |
| 4,242,900 | A | * | 1/1981 | Dixon | 72/345 |
| 4,879,894 | A | * | 11/1989 | Benedict et al. | 72/405.12 |
| 5,349,843 | A | * | 9/1994 | Hubball | 72/344 |
| 6,446,478 | B1 | * | 9/2002 | Muller | 72/306 |

FOREIGN PATENT DOCUMENTS

| | | |
|---|---|---|
| JP | 03295004 | 5/1996 |
| JP | 10137999 | 5/1998 |
| SU | 1155464 | 5/1985 |
| SU | 1426686 | 9/1988 |

* cited by examiner

PRESS

This application claims the benefit of Danish Application No. PA 2008 01454 filed Oct. 20, 2008 and PCT/DK2998.959263 filed Oct. 15, 2009, which are hereby incorporated by reference in their entirety as if fully set forth herein.

FIELD OF THE INVENTION

The present invention concerns a press, including:

a frame;

a first press bed with a first tool part, wherein the first press bed is provided between the frame and the first tool part;

first displacement means;

a second press bed with a second tool part which in use is arranged at a position opposite to the first tool part, and where the second press bed is provided between the frame and the second tool part;

a device for introducing workpieces between the first and the second tool parts;

a device for ejecting finished workpieces;

a punch which is vertically displaceable through coaxial openings in the first tool part and the second tool part;

a punch cylinder for displacing the punch.

Furthermore, the invention concerns a method for operating a press, the press including:

a frame;

a first press bed with a first tool part, wherein the first press bed is provided between the frame and the first tool part;

first displacement means;

a second press bed with a second tool part which in use is arranged at a position opposite to the first tool part, and where the second press bed is provided between the frame and the second tool part;

a device for introducing workpieces between the first and the second tool parts;

a device for ejecting finished workpieces;

a punch which is vertically displaceable through coaxial openings in the first tool part and the second tool part;

a punch cylinder for displacing the punch.

wherein the method includes the steps:

a workpiece is introduced in the press by using the device for inserting workpieces;

the first press bed or the second press bed is displaced vertically to a pressing position for the press by using the first displacement means connected between the frame and the press bed;

the workpiece is formed by moving the punch through a working stroke from a first position where the punch is outside the opening in the second tool part, to a second position where the punch is within the opening in the second tool part by using the punch cylinder;

the punch is returned to the first position;

the workpiece is ejected by using the device for ejecting finished workpieces.

In the present invention, by finished workpieces is meant workpieces that are completely processed by the press and ready for further treatment in a processing facility, e.g. further press operations or cutting of excessive material.

The terms vertical and horizontal are used for reasons of clarity based on a usual structure. Other orientations may be used provided they are approximately orthogonal to each other.

A tool for a given form of the finished workpiece in the present application consists of a first tool part, a second tool part and a punch.

BACKGROUND OF THE INVENTION

There are prior art conventional presses having a ram with a top tool which is pressed with great force against a workpiece on a bottom tool on a press table by one or more hydraulic cylinders. The workpiece is hereby retained between the tool parts with a blankholder force.

A punch connected to the frame of the press is forced through coaxial openings in the tool parts whereby an workpiece is shaped. The punch is retracted to a position outside the workpiece. Hereby, the workpiece will project into the opening of one of the tools.

The finished workpiece is ejected by lifting the top tool to a position where it is possible to remove the finished workpiece from the press. Particularly by deep workpieces, this is a drawback as the top tool has to be moved a relatively great distance before the workpiece may be ejected.

The distance by which the top tool is to be lifted greatly influences the cycle time and the energy consumption of the press.

In JP 03 295 004 B2 is indicated a press with a lower and an upper press bed. The upper press bed is provided with an upper tool and the lower press bed is provided with a lower tool. The two tools are provided opposite each other while the workpiece is pressed. The workpiece is shaped in that a punch connected to a cylinder which is connected to the frame of the press is pressed against the workpiece and draws it into an opening in the upper tool.

When the workpiece is to be ejected, the upper press bed is moved from a pressing position to an ejecting position. The upper press bed is displaced horizontally between the two positions.

A device for introducing workpieces and a device for ejecting the finished workpiece are directly connected to the upper press bed. When a workpiece is to be ejected, the upper press bed is moved to the ejection position at which the workpiece is ejected. At the same time, the device for introducing workpieces is moved to a position above the lower tool. The workpiece is placed on the tool and the upper press bed is moved to a pressing position. The device for introducing workpieces receives a new workpiece while the already introduced workpiece is pressed.

The upper press bed is connected to the machine frame through a rail arrangement. The frame is open at the top such that the devices for ejecting the workpiece and introducing a workpiece, respectively, can be displaced horizontally without colliding with any part of the machine.

A drawback of the press indicated in JP 03 295 004 B2 is the relatively large mass to be moved each time a workpiece is to the ejected and a new workpiece introduced.

The mass of the upper press bed, the upper tool, the device for ejecting the workpiece and the device for introducing workpieces are to be accelerated in speed for moving to the ejection position, braked for ejection, accelerated in opposite direction for moving to the pressing position and braked for pressing. A press bed with relatively great speed requires relatively strong displacement means in order to attain a short cycle time. Alternatively, the cycle time becomes long.

The energy consumption of such a machine is relatively big if a short cycle time is desired.

Another drawback is the limit to the size of the area of the cut out in the upper press bed for the workpieces which may be shaped in the press, without the upper press bed having to be substituted by a second upper press bed with another dimension of the opening as the workpiece penetrates into the opening in the upper press bed.

Object of the Invention

It is the object of the invention to indicate a press with a short cycle time for even deep workpieces, a low weight and a low energy consumption.

Another object of the invention is that the press should be suited for use with tools that are backward compatible with existing presses.

DESCRIPTION OF THE INVENTION

According to the present invention, this is achieved by a press of the type mentioned in the introduction which is peculiar in that it furthermore includes second displacement means which are attached between the frame and the second tool part for horizontal displacement of the second tool part between a pressing position with the openings aligned, and an ejecting position with the opening of the second tool part outside the press beds, and that the first displacement means are connected between the frame and the first press bed, where the first press bed is vertically displaceable, and where the second press bed is fastened to the frame, or that the first displacement means are connected between the frame and the second press bed, where the second press bed is vertically displaceable, and where the first press bed is fastened to the frame.

Furthermore, it is achieved by a method of the type mentioned in the introduction, which is peculiar in that second displacement means are provided connected between the frame and the second tool part for horizontal displacement of the second tool part, that the second tool part is displaced horizontally between the pressing position where the openings are aligned, and an ejection position where the opening of the second tool part is disposed outside the press beds under application of the other displacement means.

Hereby it becomes possible to attain a short cycle time as it is only one tool part which is displaced between the pressing position and the ejection position. This limits the inertia of the displaced machine part the most possible such that less energy is required to accelerate and brake the machine part when it is moved between the pressing position and the ejection position.

The horizontal displacement of the tool part enables ejection of even deep workpieces. The cycle time remains largely the same by changing between tools with different depth of workpiece.

Fully automatic prior art presses with robotic feeding may typically produce 3-4 workpieces per minute. By a press according to the invention, an output of more than 4.5 workpieces per minute can be achieved, with a reduction in energy consumption of more than 35%. For a press with a utilization coefficient of 80%, this will entail an increased production on a yearly basis of more than 80,000 workpieces by operation in two shifts.

The second tool part will typically be disposed in a slide which is displaced out of and into the press. The slide and the associated guides are not used for transmitting forces during the pressing of the workpiece.

As one of the press beds is stationary, it therefore becomes possible to construct the frame in a way such that the forces arising during pressing of a workpiece may efficiently be transmitted from the press beds, which constitute a large supporting surface for the tool parts, to the frame.

The frame will typically be composed of a number of aligned side members which are welded together. The side members are adapted such that they enclose the press beds and the tool parts. The frame has a through-going opening at opposite sides of the press, allowing horizontal displacement of the second tool part outside the press and introduction of workpieces, in addition to replacement of tools.

This structural optimisation of the frame entails a weight saving compared with conventional presses. This weight saving reduces the costs of making the press and when making the foundation of the press.

The first and second press beds may be adapted in size, shape and with tool fastenings such that it will accept tools from conventional presses. Thereby, the press becomes backwards compatible with tools from existing presses.

The first or the second press bed is vertically displaceable for establishing a blankholder force on the workpiece during pressing or for establishing the working force. The first displacement means are connected between the frame and the displaceable press bed. The stationary press bed is fastened to the frame.

The press is particularly well suited as deep drawing, as here the case is often deep workpieces. In a conventional press, ejection will require long travel of the cylinder moving the ram, since it has to move a distance at least corresponding to the depth of the workpiece. The ram from the conventional press corresponds to the displaceable press bed in the present invention.

According to a further embodiment, the press according to the invention is peculiar in that the punch cylinder is connected between the first press bed and the punch.

Hereby is achieved that the rod connection between punch and punch cylinder is reduced.

It is advantageous to have the fewest possible joints and a short and rigid rod connection between punch cylinder and punch, as pressing of the workpieces occurs under great pressure.

While building up pressing pressure, the punch and the punch cylinder will become pre-stressed, at the same time as deformation of the workpiece begins. At the end of the pressing, when the pressure is removed, the pre-stressing of the punch and the punch cylinder will decrease such that they achieve their original length while the deformation of the workpieces gradually ceases. This will be a dampening with regard to control of the speed and travel of the piston.

The shorter rod connection and the fewer joints, the less the punch and the punch cylinder will be compressed and the easier it can be ensured that the workpieces are drawn uniformly every time, and hereby it is easier to provide a uniform quality.

According to a further embodiment, the press according to the invention is peculiar in that the first tool part is arranged at a position under the second tool part.

When the first press bed is vertically displaceable, it is achieved that the first displacement means only need to be one-way force providers, as the first press bed will be displaced in the second direction under the action of gravity.

When the second press bed is vertically displaceable, it is achieved that the dimension of the first displacement means is not limited by the size of the pressing piston, as the first displacement means are provided between the frame and the second press bed at the opposite side of the press.

According to a further embodiment, the press according to the invention is peculiar in that the first tool part is arranged at a position above the second tool part.

This is particularly advantageous in connection with working with workpieces which are pressed several times, for example in connection with some kinds of deep drawing where a first draw and a second draw are applied, but is also justified by heavy, unwieldy workpieces.

The second tool part is displaced out of the press, and a workpiece which has been drawn for the first time is placed upon the second tool part with the drawn part of the workpiece in the opening of the second tool part. The second tool part is then displaced into the press to a position opposite to the first tool part. Then the second drawing is performed.

Where the first press bed is vertically displaceable and where the second press bed is stationary, the vertical displacement of the first press bed is furthermore limited, since it is not necessary for the first displacement means to be displaced a distance at least corresponding to the height of the partially drawn workpiece.

Where the second press bed is vertically displaceable and the first press bed is stationary, and where the second tool part is disposed at a position under the first tool part, the first displacement means may be one-way force providers, as the second press bed will be displaced in the second direction under the action of gravity.

According to a further embodiment, the press according to the invention is peculiar in that the first displacement means are hydraulic cylinders.

Hydraulic cylinders can be made with a relatively long travel in relation to e.g. hydraulic membranes. Hydraulic cylinders are used where the displacement of the vertically displaceable press bed is desired to be large.

This is a particular advantage in connection with working workpieces which are pressed several times, for example in connection with deep drawing where a first draw and a second draw are applied, or by pressing workpieces that require great clearance height in order to get into the press.

By the second draw, the workpiece will be partially formed when passed into the pressing machine after the first draw. Therefore, the workpiece has a height corresponding to the height of the partially finished workpiece. The vertically displaceable press bed has to be able to be displaced such a distance that it is possible to introduce the workpiece in the gap between the first and the second tool parts.

Moreover, it is achieved that the press can accept tools with greater variation in installation height because they have longer travel and thus may compensate for such a variation.

According to a further embodiment, the press according to the invention is peculiar in that the first displacement means are hydraulic membranes.

Hydraulic membranes have relatively short travel. At the same time, they have very small installation height.

By workpieces that may be formed by one pressing or by the first pressing for workpieces shaped in several cycles, advantageously there may be selected a press with hydraulic membranes.

It is only necessary to displace the first press bed so much that there is room for a flat blank between first and second tool parts. Typically, one may suffice with a displacing length of 2 to 15 mm.

According to a further embodiment, the press according to the invention is peculiar by further including:

at least one further punch which is vertically displaceable through additional coaxial openings in the first tool part and the second tool part; and an additional punch cylinder for displacing the at least one further punch.

Hereby it is achieved to enable making of workpieces that have several depressions. This may e.g. be kitchen sinks with several basins.

The penetration of the pistons into the workpiece during a forming stroke may have varying depth.

According to a further embodiment, the press according to the invention is peculiar in that the second displacement means are adapted for horizontal displacement of the second tool part between the pressing position with the openings aligned and a loading position with the opening of the second tool part outside the press beds.

Hereby is achieved that the press may readily be used for workpieces which already have been drawn at least once. When the second tool part is moved to the loading position with the opening of the second tool part outside the press beds, the workpiece can be placed on or up in the second tool part without consideration to the clearance height between the two tool parts in the press, as the part of the workpiece which is higher than the flat preform is contained in the opening of the second tool part during displacement to the pressing position.

Moreover, it is thus also achieved that the first displacement means may be hydraulic membranes with short travel as only a limited clearance height may be required for introducing the already drawn workpiece into the press.

According to a further embodiment, the method according to the invention is peculiar in that the speed of the punch and the speed of the additional punch are controlled such that the relative position of the individual punch relative to the full working stroke of the individual punch is the same for the punchs during the entire work stroke.

It is of great importance that the speed of the pistons is controlled such that they all initiate the pressing at the same time, that they are at the same relative depth with regard to the work stroke of the individual piston at any time during the pressing, and that they terminate the pressing at the same time.

The workpiece is formed by a combination of stretching and of material being drawn in by the punch. In order that this stretching and drawing can be distributed as optimally as possible between the different depths, it is necessary that the pressing occurs simultaneously for all depressions. In the opposite case there will be a great risk that the material in the bridge between adjacent depressions will crack and thereby render the workpiece useless.

It is an advantage to combine this embodiment with the embodiment where each single punch cylinder is directly connected between the first press bed and each single punch, as it is important to control the position of the individual punch in relation to other punchs such that the pre stressing of the press by action of blankholder force and pressing force is influencing the position of the punchs as little as possible.

By the said embodiment, the dampening in the punch cylinders and the punchs will be less such that controlling the speed of the individual punch becomes more precise.

According to a further embodiment, the method according to the invention is peculiar in that the workpiece introduction step is performed about the same time as the workpiece ejection step.

Hereby, a further reduction in cycle time is achieved, as the device for introducing workpieces will place a workpiece in the press simultaneously with the second tool part being moved to the ejection position. The workpiece is thus ready for pressing when the second tool part returns to the pressing position. This embodiment may advantageously be used for the first pressing of a deep drawn workpieces as this process normally takes long time, and hereby a substantial time saving is achieved in the cycle.

In an embodiment of the machine where the first tool part is arranged at a position under the second tool part, the device for introducing workpieces may be connected to the second tool part such that the other displacement means also displace the device for introducing workpieces. Typically, the second tool part will be located in a slide to which the device for introducing workpieces is connected.

The device for introducing workpieces will follow into the press and let go of the workpiece over the first tool part. When the second tool part is displaced to the pressing position, the device for introducing workpieces is out of the press again.

According to a further embodiment, the method according to the invention is peculiar in that the workpiece introduction step includes additional steps, during which:

the second tool part is displaced horizontally to a loading position by using the second displacement means, where the opening of the second tool part is disposed outside the press beds;

the workpiece is placed upon or up in the second tool part by using the device for introducing workpieces;

the second tool part is displaced horizontally to the pressing position, where the openings are aligned, by using the second displacement means.

Hereby is achieved that the press may readily be used for workpieces which already have been drawn at least once. When the second tool part is moved to the loading position with the opening of the second tool part outside the press beds, the workpiece can be placed on or up in the second tool part without regard to the clearance height between the two tool parts in the press, as the part of the workpiece which is higher than the flat preform is contained in the opening of the second tool part during displacement to the pressing position.

In an embodiment of the machine where the first tool part is arranged at a position over the second tool part, the device for introducing workpieces may be disposed outside the press. The loading is hereby effected by placing the workpiece on the second tool part.

In an embodiment of the machine where the second tool part is arranged at a position over the first tool part, the device for introducing workpieces may be disposed outside the press. The loading is hereby effected by placing the workpiece up into the second tool part.

The device for introducing workpieces can be disposed at the opposite side of the press like the device for ejection of finished workpieces. In this embodiment, the loading position is different from the ejection position for the second tool part.

The device for introducing workpieces can be disposed opposite to the device for ejection of finished workpieces and at the same side of the press. In this embodiment, the loading position coincides with the ejection position for the second tool part.

DESCRIPTION OF THE DRAWING

The invention will be explained in more detail below with reference to the accompanying drawing, where.

In the explanation of the Figures, identical or corresponding elements will be provided with the same designations in different Figures. Therefore, no explanation of all details will be given in connection with each single Figure/embodiment.

DETAILED DESCRIPTION OF THE INVENTION

Figure 1:
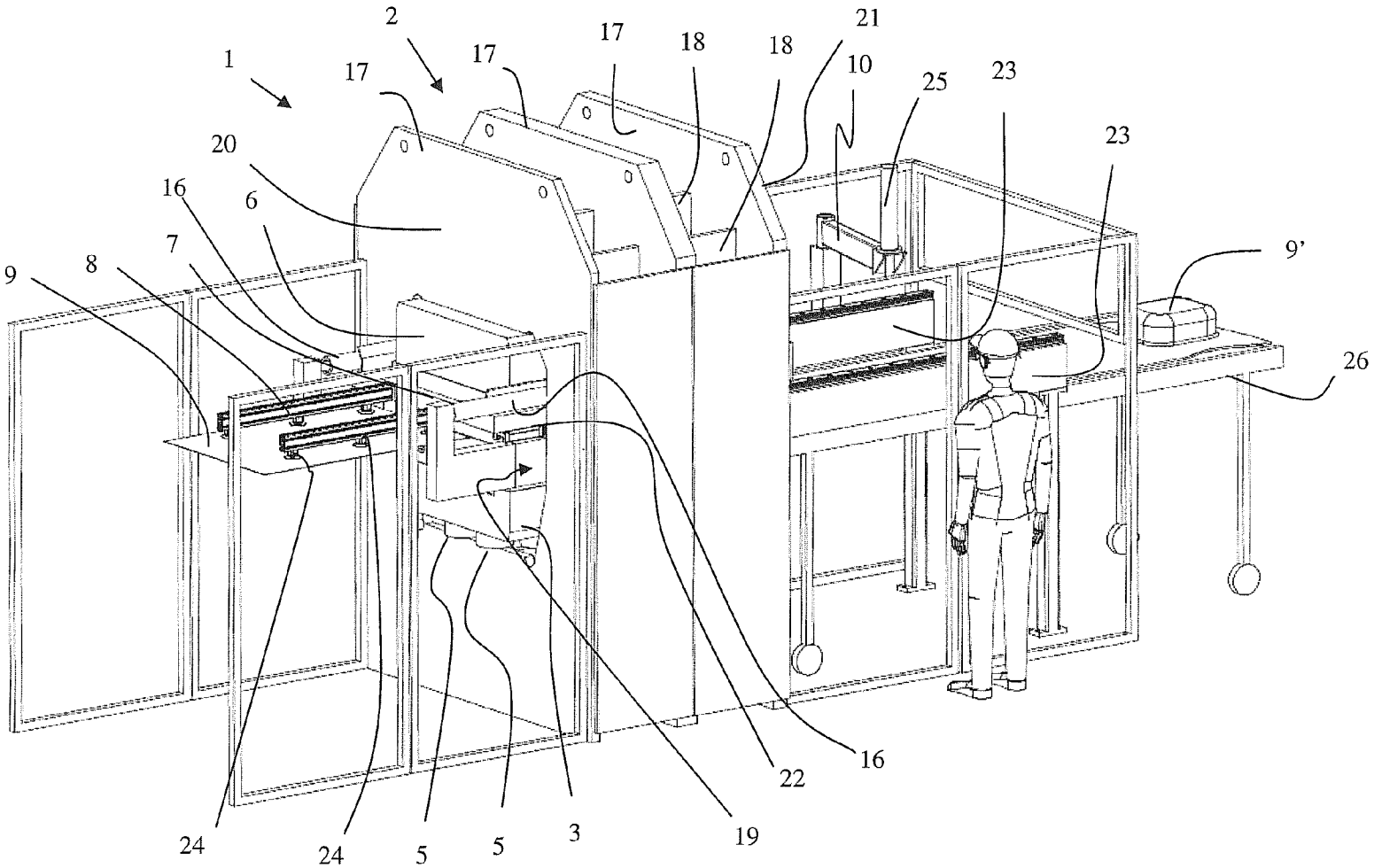
FIG. 1 shows a press in a first embodiment with the second tool part in pressing position.
Figure 2:
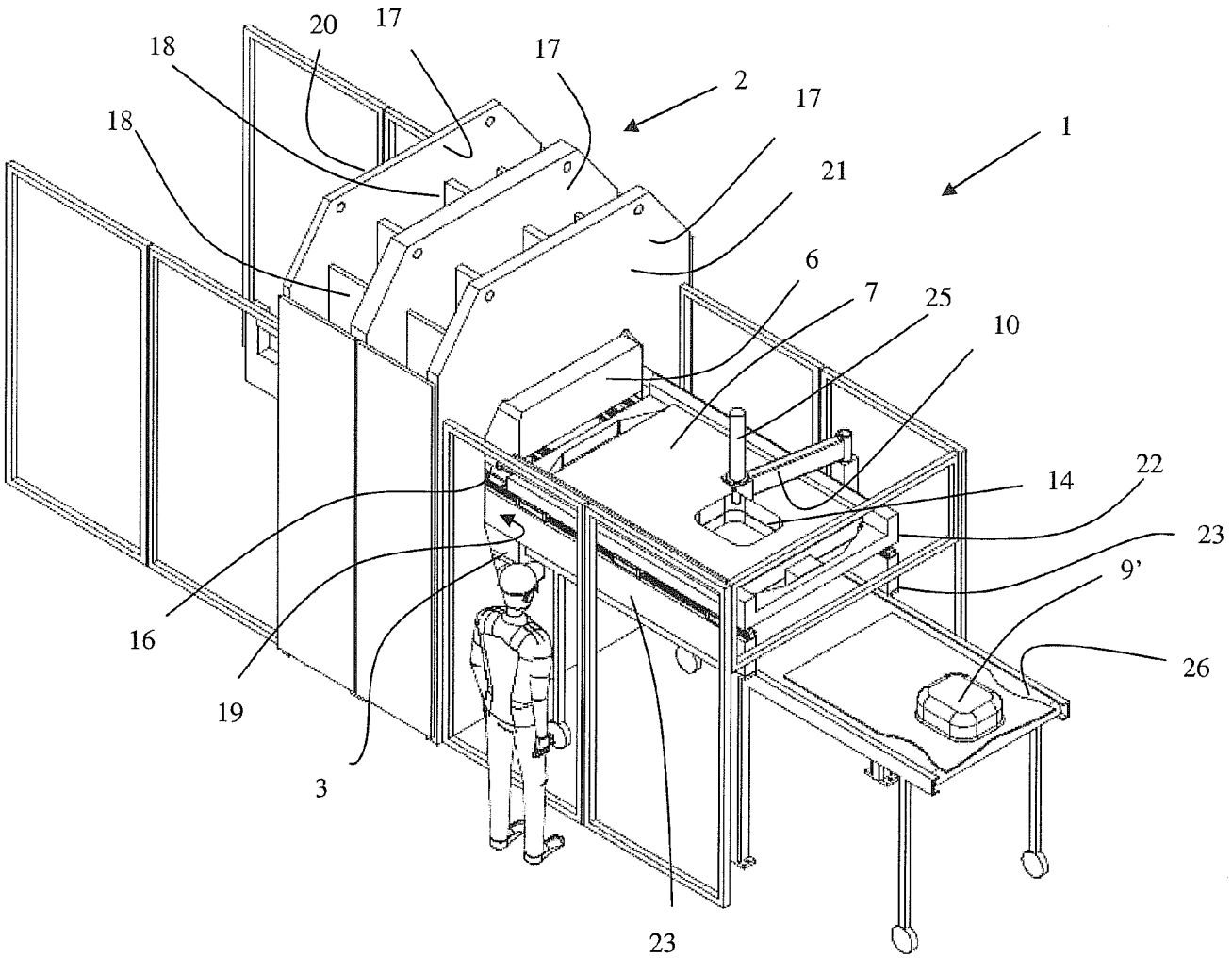
FIG. 2 shows a press in a first embodiment with the second tool part in ejection position.

FIGS. 1 and 2 show isometric illustrations of a press 1. On FIG. 1, the press 1 is shown in a pressing position, and on FIG. 2, the press 1 is shown in an ejection position.

The press 1 has a frame 2 which in the shown embodiment consists of three side members 17 which are connected by frame members 18 in a welded construction. The frame is provided a through-going opening 19 in two opposite sides 20, 21. The press 1 in the shown embodiment is a deep drawing press.

In the shown embodiment of the press 1, a first press bed 3 is disposed in the lowermost part of the opening 19. A number of first displacement means 5 are connected between the frame 2 and the first press bed 3 such that the first press bed 3 can be displaced vertically. A first tool part 4 is fastened to the top side of the first press bed 3.

In the shown embodiment of the press 1, a second press bed 6 is disposed in the uppermost part of the opening 19. The second press bed 6 is stationary and fastened to the frame 2. A second tool part 7 is disposed in a slide 22 which may be displaced horizontally into and out of the press 1 on two guides 23 under the action of second displacement means 16. The second tool part 7 has a position inside the press 1 which is a pressing position (see FIG. 1), and another position outside the press 1 which is an ejecting position (see FIG. 2).

A workpiece 9 is placed between the first 4 and the second tool parts 7 by using a device 8 for introducing workpieces 9. The device 8 for introducing workpieces 9 is connected to the slide 22 and may also be displaced horizontally into and out of the press 1.

The device 8 for introducing workpieces 9 has a number of suction discs 24 by which it sucks on a workpiece 9 outside the press 1 while a workpiece 9' is pressed inside the press 1. When the second tool part 7 is moved to the ejection position, the device 8 for introducing workpieces 9 follows with it into the opening 19 in the press 1. Vacuum is removed from the suction discs 24 so that the workpiece 9 is placed on the surface of the first tool part 4.

The finished workpiece 9' is ejected by using a device 10 for ejecting finished workpieces 9'. The second tool part 7 is moved to the ejection position where the workpiece 9' is pushed out of the second tool part 7 with an ejector cylinder 25. The finished workpiece 9' falls down on a conveyor belt 26, after which it is moved on to a process facility (not shown) for further working.

Figure 3:
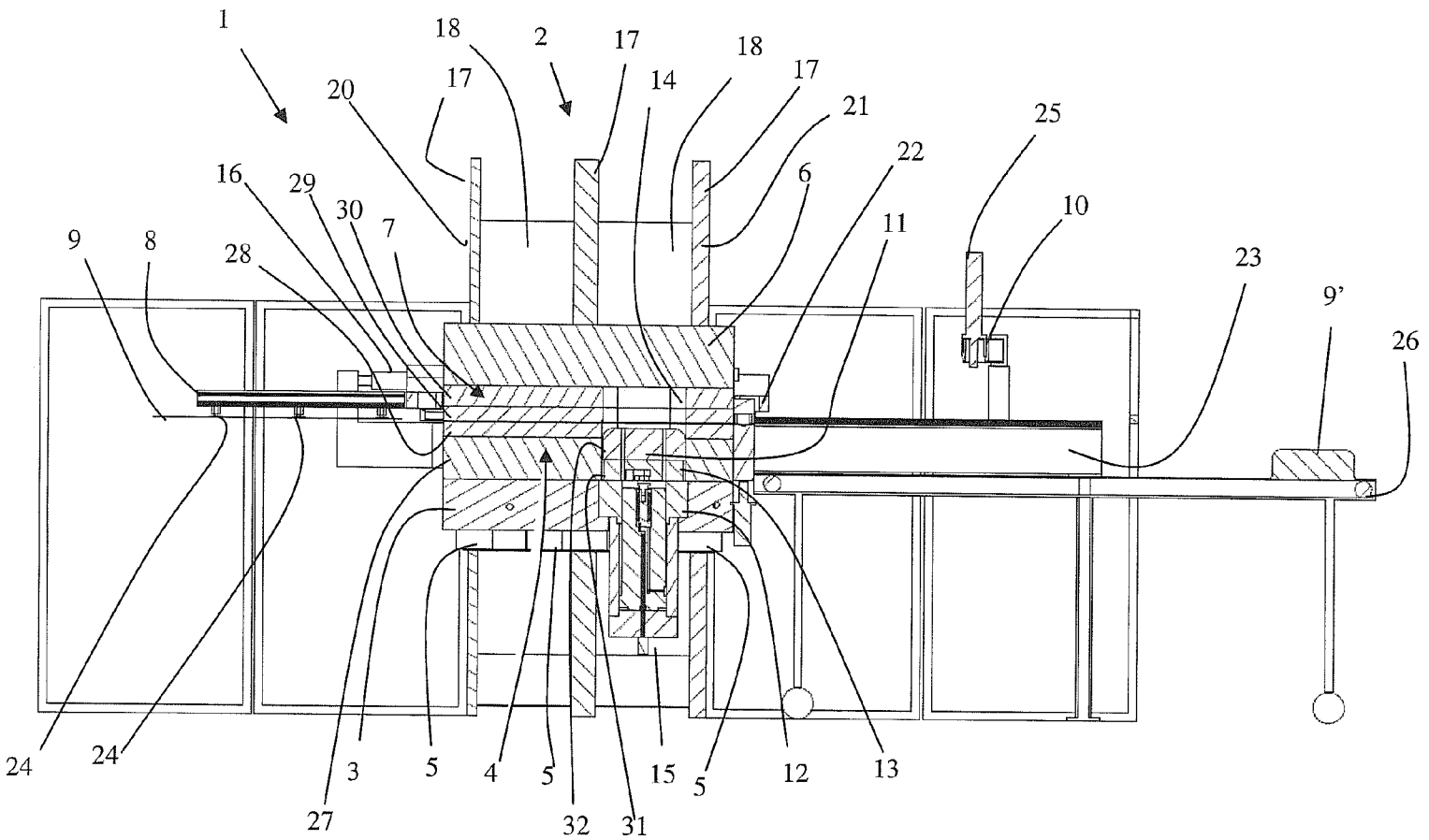
FIG. 3 shows a cross-section of a press in a first embodiment with the second tool part in pressing position.
Figure 4:
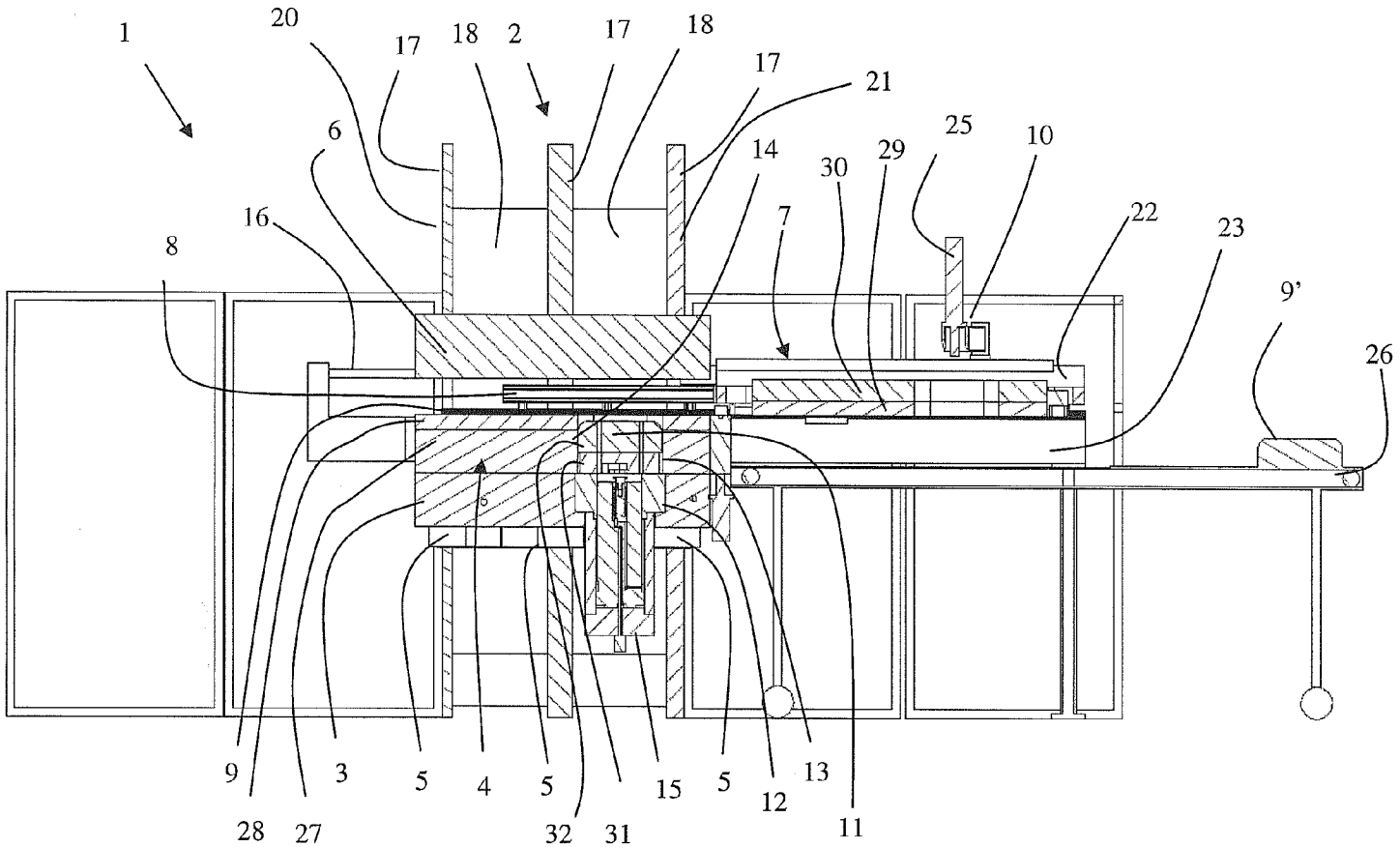
FIG. 4 shows a cross-section of a press in a first embodiment with the second tool part in ejection position.

FIGS. 3 and 4 show a cross-section through the press 1. On FIG. 3, the press 1 is shown in a pressing position, and on FIG. 4, the press 1 is shown in an ejection position.

In the pressing position, coaxial openings 13, 14 in the first tool part 4 and the second tool part 7 are aligned.

In the ejection position, the opening 14 of the second tool part is located outside the press beds 3, 6.

A workpiece 9 is introduced in the press in the pressing position on FIG. 3. The first press bed 3 is displaced such that the first tool part 4 bears on the workpiece 9 which is supported by the second tool part 7.

This displacement is typically a distance of 2-15 mm, preferably 10 mm, for a workpiece 9' which is pressed in one cycle, or for the first pressing of an workpiece 9' which is pressed several times. In that case, the first displacement means 5 will be hydraulic membranes which are incorporated in the first press bed 3.

For presses 1 for successive pressings of a workpiece 9', the displacement is by a distance that enables introducing the workpiece 9 with the partially shaped workpiece 9' between the first tool part 4 and the second tool part 7, and for presses where the installation height of the individual tool parts 4, 7 varies greatly. In these cases, the first displacement means 5 will be hydraulic cylinders which are built into in the first press bed 3.

The pressure in the first displacement means 5 is increased, causing the pressure on the workpiece 9 to rise as the second tool part 7 and the second press bed 6 support the workpiece 9, transmitting the forces to the frame 2. This ensures that the workpiece 9 is sufficiently retained while the workpiece 9' is pressed such that no wrinkles are formed in the finished workpiece 9'.

The workpiece 9' is formed by applying a punch 11 which is vertically displaceable through the coaxial openings 13, 14 in the first tool part 4 and the second tool part 7. The punch 11 is displaced by using a punch cylinder 15 connected between the punch 11 and the first press bed 3.

When the punch 11 meets the workpiece 9, the shaping of the workpiece 9 is initiated. The punch continues its travel into the coaxial opening 14 in the second tool part 7. During this action, the workpiece 9 is drawn into the second tool part 7 until the punch 11 has reached it pre-programmed work stroke and the finished workpiece 9' is formed. One side of the workpiece 9' is formed by the shape of the second tool part 7, and the other side of the workpiece 9' is formed by the shape of the punch 11.

The punch 11 is returned to a position outside the workpiece 9'. The workpiece 9' may then be moved out of the press 1 for ejection. The workpiece 9' can be ejected when the coaxial opening 14 is outside the first 3 and the second 6 press beds.

In the shown embodiment of the press 1, the first tool part 4 includes a first base plate 27 and a blank holder 28.

The blank holder 28 provides direct contact to the workpiece and it therefore made of a very hard-wearing material.

The first base plate 27 forms the base of the blank holder 28 and provides good rigidity to the first tool part 4. The first base plate 27 and the blank holder 28 are higher than the punch 11. The punch 11 may hereby be completely contained in the opening 13 in the first tool part 4.

In the shown embodiment of the press 1, the second tool part 7 includes a second base plate 30 and a draw ring 29.

The draw ring 29 provides direct contact to the workpiece and is therefore made of a very hard-wearing material. Moreover, the workpiece is shaped via the opening in the draw ring when the punch is pressed up through the second tool part 7.

The second base plate 30 forms the base of the draw ring 29 and provides good rigidity to the second tool part 7. The draw ring 29 and the second base plate 30 are just so high that the drawn workpiece can be completely contained in the opening 14 in the second tool part 7.

In the shown embodiment of the press 1, the punch 11 includes a third base plate 31 and a forming piston 32.

The forming piston 32 is made of a very hard-wearing material as it has direct contact with the workpiece 9. The base plate 31 forms a base for the forming piston 31 with the purpose of connecting the forming piston 32 and the punch cylinder 15 as well as guiding the punch 11 through the first tool part 4 via guides in the first tool part 4.

The blank holder 28, the draw ring 29 and the forming piston 32 can be dismounted and replaced or renovated when they are worn to such a degree that the finished workpiece 9' does not meet geometric tolerance requirements.

Figure 5:
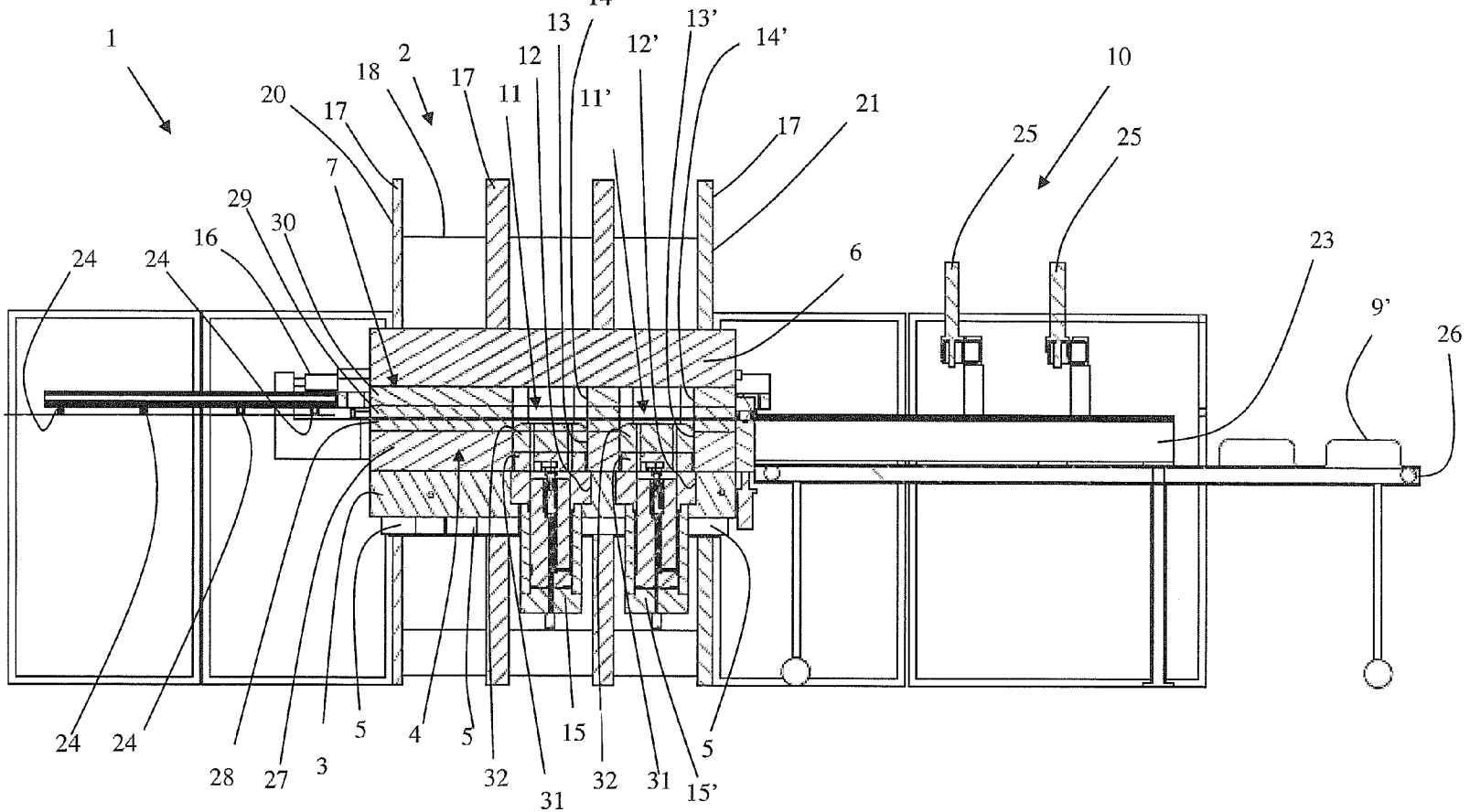
FIG. 5 shows a cross-section of a press in a second embodiment with a further punch with the second tool part in pressing position.
Figure 6:
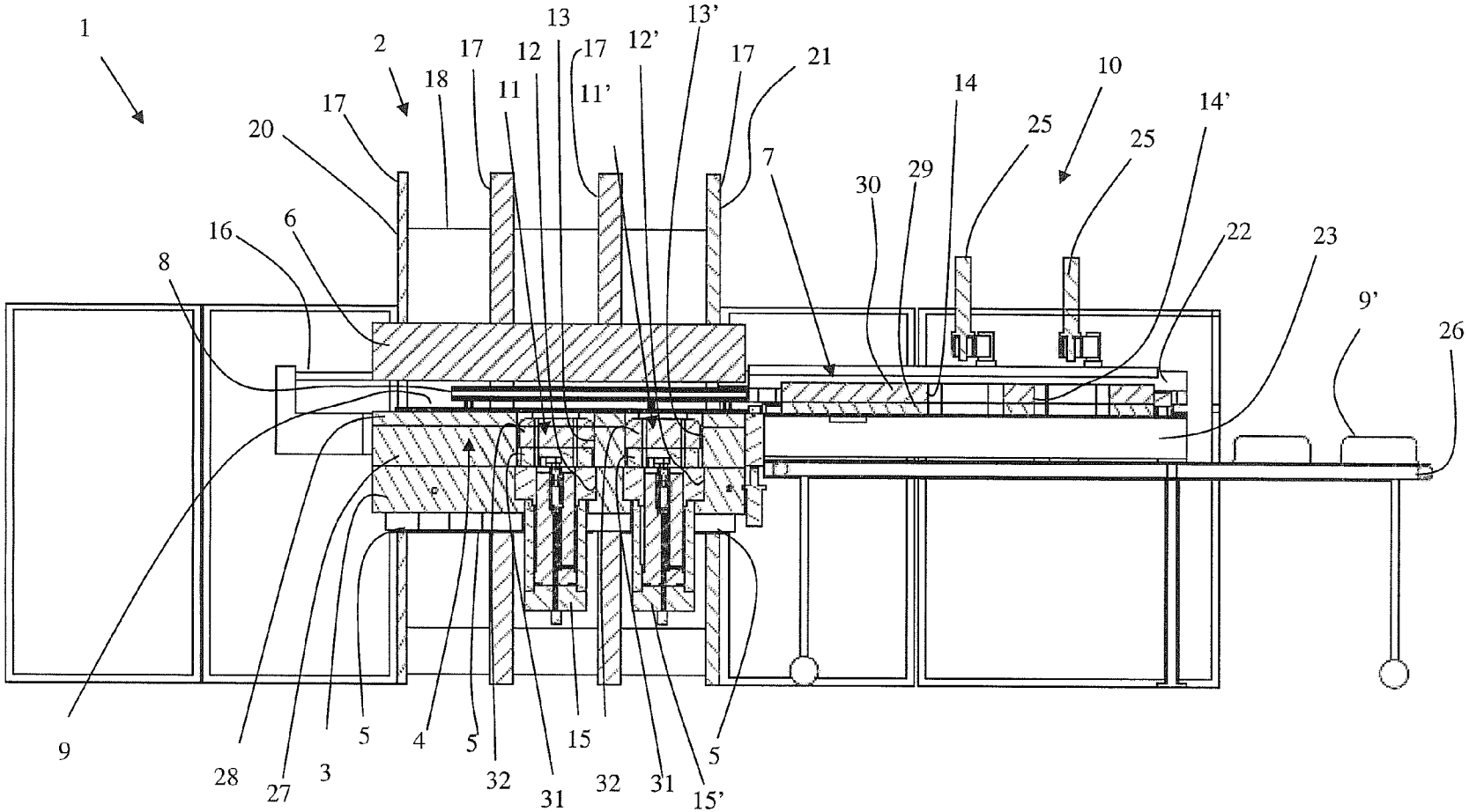
FIG. 6 shows a cross-section of a press in a second embodiment with a further punch with the second tool part in ejection position.

FIG. 5 shows a cross-section of a press 1 with a further punch 11' with a second tool part 7 in pressing position, and FIG. 6 shows a cross-section of a press with a further punch 11' with the second tool part 7 in ejection position.

The further punch 11' is displaced through further coaxial openings 13', 14' in the first 4 and the second tool parts 7, respectively, for forming additional depressions in the finished workpiece 9'. The press 1 is provided with a control (not shown) regulating the relative position of the punchs 11, 11' in relation to their work strokes so that it is the same for the two punchs 11, 11'. This means that they start the drawing simultaneously and end the drawing simultaneously, irrespective of the depth of the depression. During ejection, the opening 14 and the additional opening 14' in the second tool part 7 are both to be outside the press beds 3, 6.

Figure 7C:
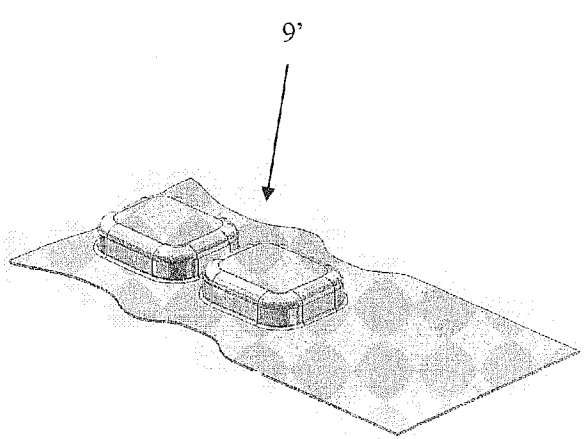
FIG. 7*c* shows the finished workpiece after the first draw with two bowls.
Figure 7B:
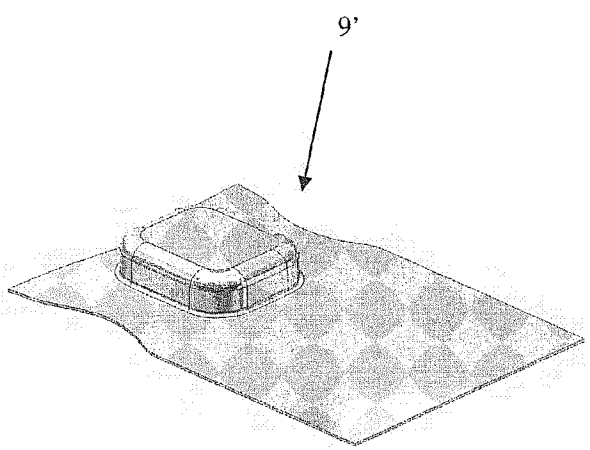
FIG. 7*b* shows the finished workpiece after first draw with one bowl.
Figure 7A:
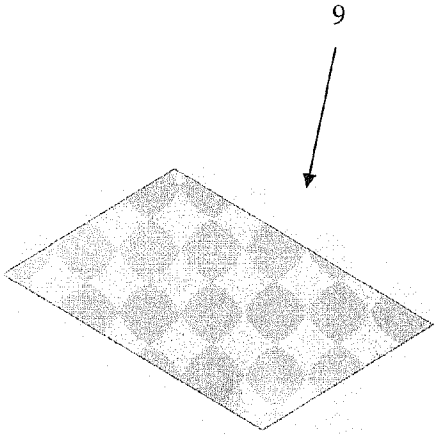
FIG. 7*a* shown a workpiece for deep draw.

FIG. 7*a* shows a workpiece 9. The workpiece 9 may e.g. be steel or stainless steel with a thickness between 0.3 and 1.5 mm.

FIG. 7*b* shows an example of a workpiece 9'. The workpiece 9' is made of a workpiece 9 of stainless steel with a thickness of 0.8 mm, where the workpiece 9' is a sink with the dimensions 480 mm×340 mm and a depth of 155 mm. The blank holding force for such a workpiece is normally between 500 and 1000 tonnes. The punch cylinder 15 is typically dimensioned to deliver a working force up to 125 tonnes. Normally, a certain speed or speed profile is chosen for the punch 11. The force delivered by the punch cylinder 15 will then depend on the speed of the punch and geometry and material properties of the workpiece.

FIG. 7*c* shows an example of another workpiece 9'. The workpiece 9' is made of a workpiece 9 of stainless steel with a thickness of 0.8 mm, where the workpiece 9' is a double bowl sink, both with the dimensions 400 mm×340 mm and a depth of 155 mm.

The workpiece is made with a press 1 having an additional punch 11' with a further punch cylinder 15' and additional openings 13', 14' in the first tool part and the second tool part 7.

Figure 8:
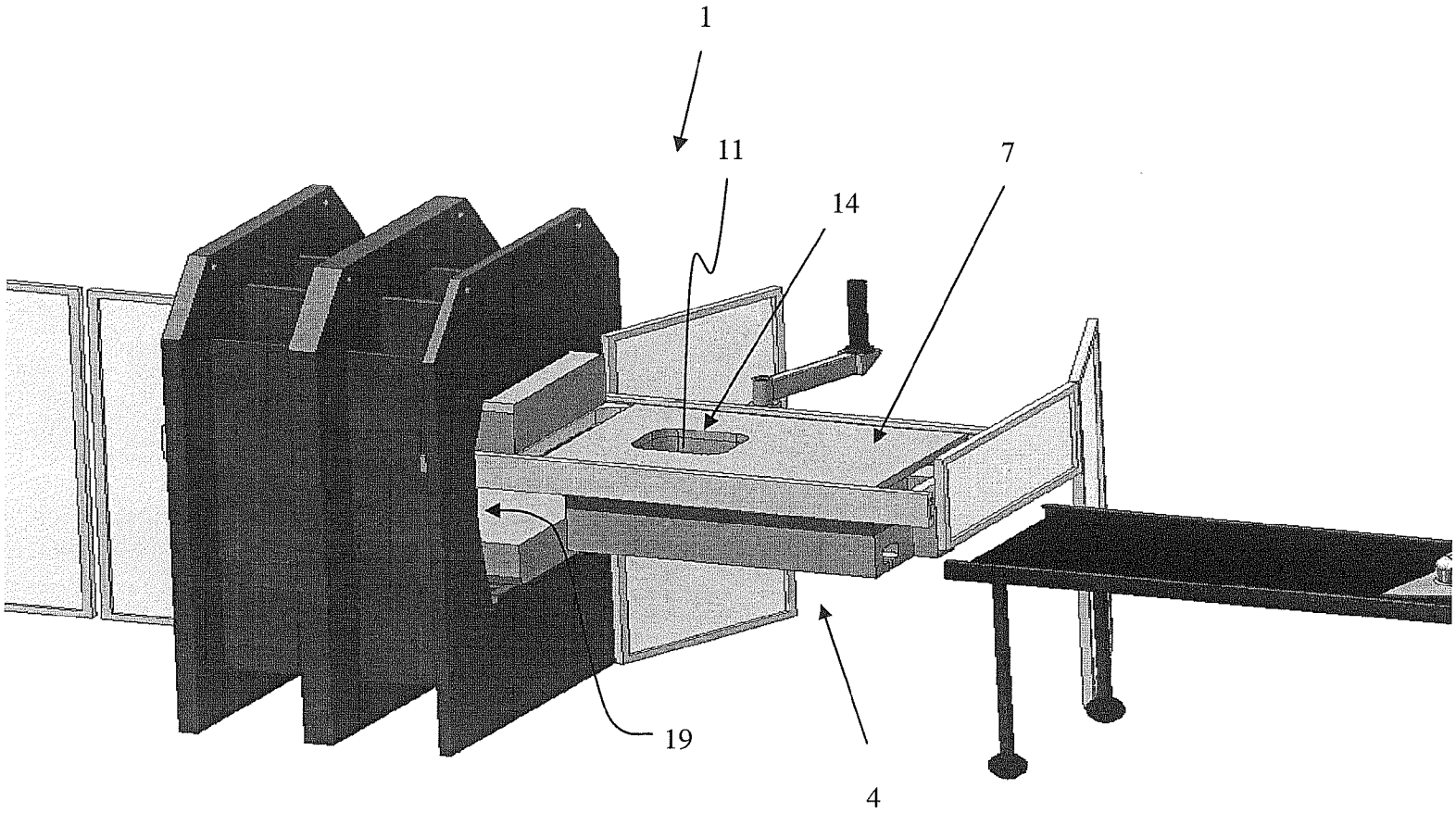
FIG. 8 illustrates shifting of a tool.

FIG. 8 illustrates how a tool change can be performed.

The initial position of the press 1 is the pressing position.

The first tool part 4 is pushed up against the second tool part 7 by using the first displacement means 5, after which they are fastened by using fastening tools.

The connection of the punch to the punch cylinder 15 is designed such that it is possible to disconnect the punch 11, either semiautomatically or fully automatically in connection with the first tool part 4 and the second tool part 7 being moved out of the press. The punch 11 is then partially supported by the first tool part 4.

The first tool part 4, the second tool part 7 and the punch 11 are displaced out of the press by using the other displacement means 16.

The tools may then be removed from the press 1 as a unit and moved to a tool storage and replaced with other tools for another workpiece.

Figure 9:
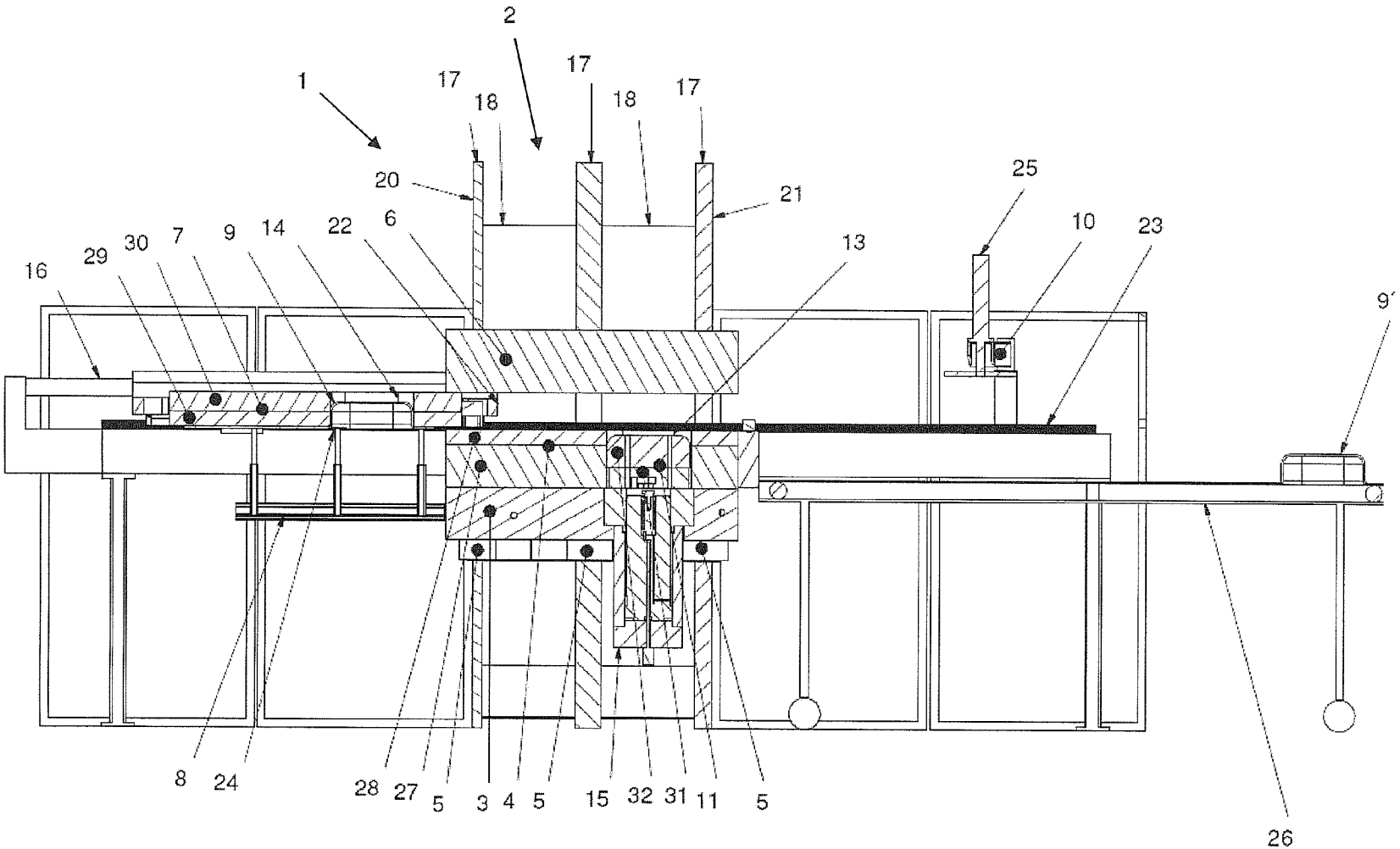
FIG. 9 shows a cross-section of a press in a third embodiment with the second tool part in a loading position.
Figure 10:
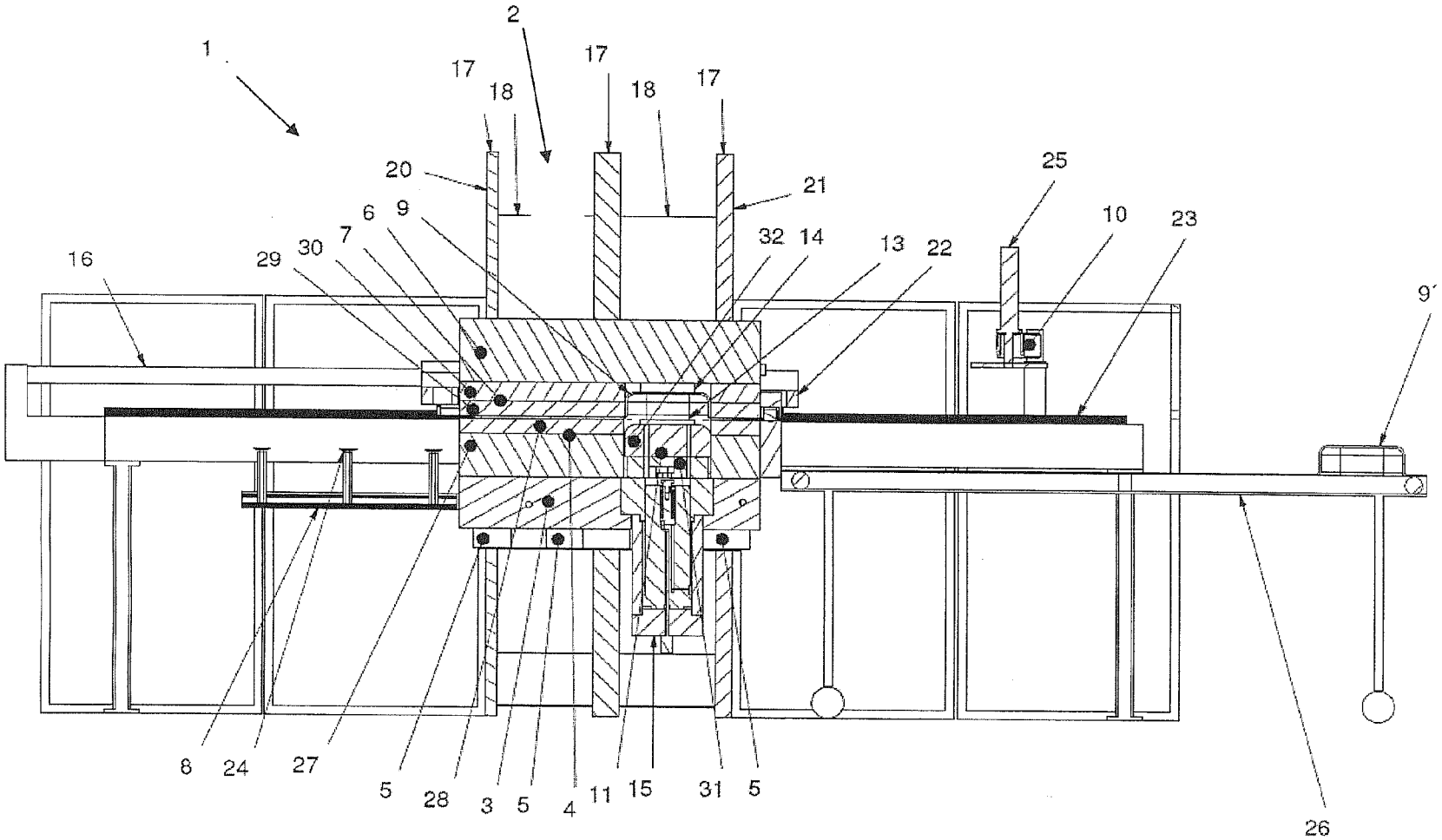
FIG. 10 shows a cross-section of a press in a third embodiment with the second tool part in a pressing position.
Figure 11:
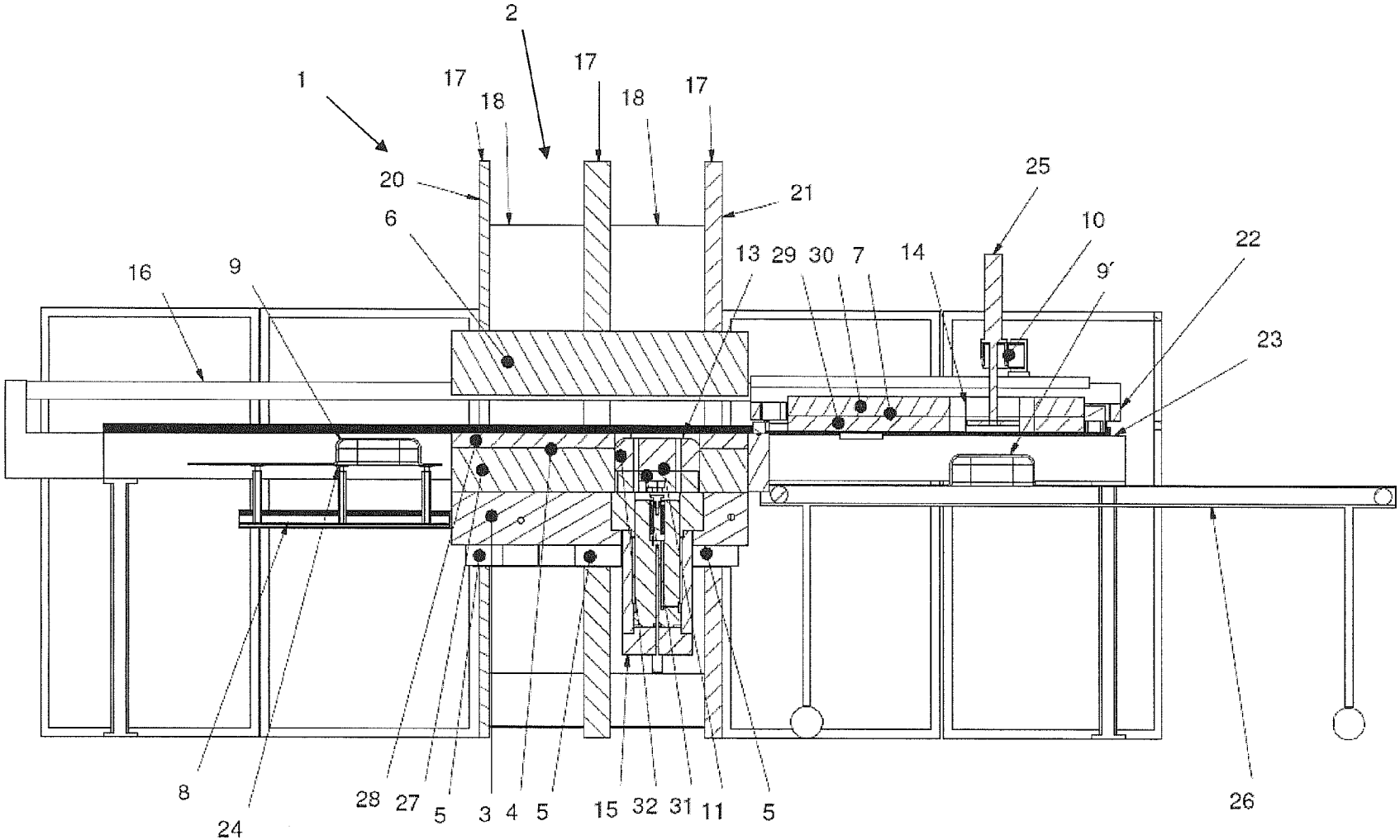
FIG. 11 shows a cross-section of a press in a third embodiment with the second tool part in an ejection position.

FIGS. 9-11 shows a cross-section of a press 1 in a third embodiment where the first press bed 3 with the first tool part 4 is arranged under the second press bed 6 with the second tool part 7. The first displacement means 5 are provided between the frame 2 and the first press bed 3, and the second displacement means 16 are arranged between the second tool part 7 and the frame 2. The second displacement means 16 are adapted for horizontal displacement of the second tool part 7 between three horizontal positions. One position is a loading position where the opening 14 of the second tool part is outside the press beds 3, 6, and on the one side of the press 1 in the shown embodiment. The other position is a pressing position with alignment of the openings 13, 14 of first and second tool parts, respectively. The third position is an ejecting position where the opening 14 of the second tool part is outside the press beds 3, 6 and on the other side of the press 1.

On FIG. 9, the press 1 is shown in the loading position. A partially drawn workpiece 9 is placed on the second tool part 7 with the projecting part of the workpiece contained in the opening 14 of the second tool part. The workpiece 9 is introduced by means of a device 8 for introducing workpieces. The workpiece 9 is moved by the second tool part 7 into the press 1 when the second displacement means 16 are displaced towards the pressing position.

On FIG. 10, the press 1 is shown in the pressing position where the workpiece 9 which is partially drawn is inserted in the press 1 to a position where the first and second tool part openings 13, 14 are aligned, and the punch 11 can be displaced for additional shaping of the workpiece 9. The workpiece 9 is retained as a blank holding force is applied by displacing the first displacement means 5 which displace the first press bed 3 with the first tool part 4.

On FIG. 11, the press 1 is shown in the ejection position. The second tool part 7 is displaced under the action of the second displacement means 16 to the ejection position. The finished workpiece 9' is ejected by means of the ejector cylinder 25 and ready for further transport on the conveyor belt 26.

Figure 12:
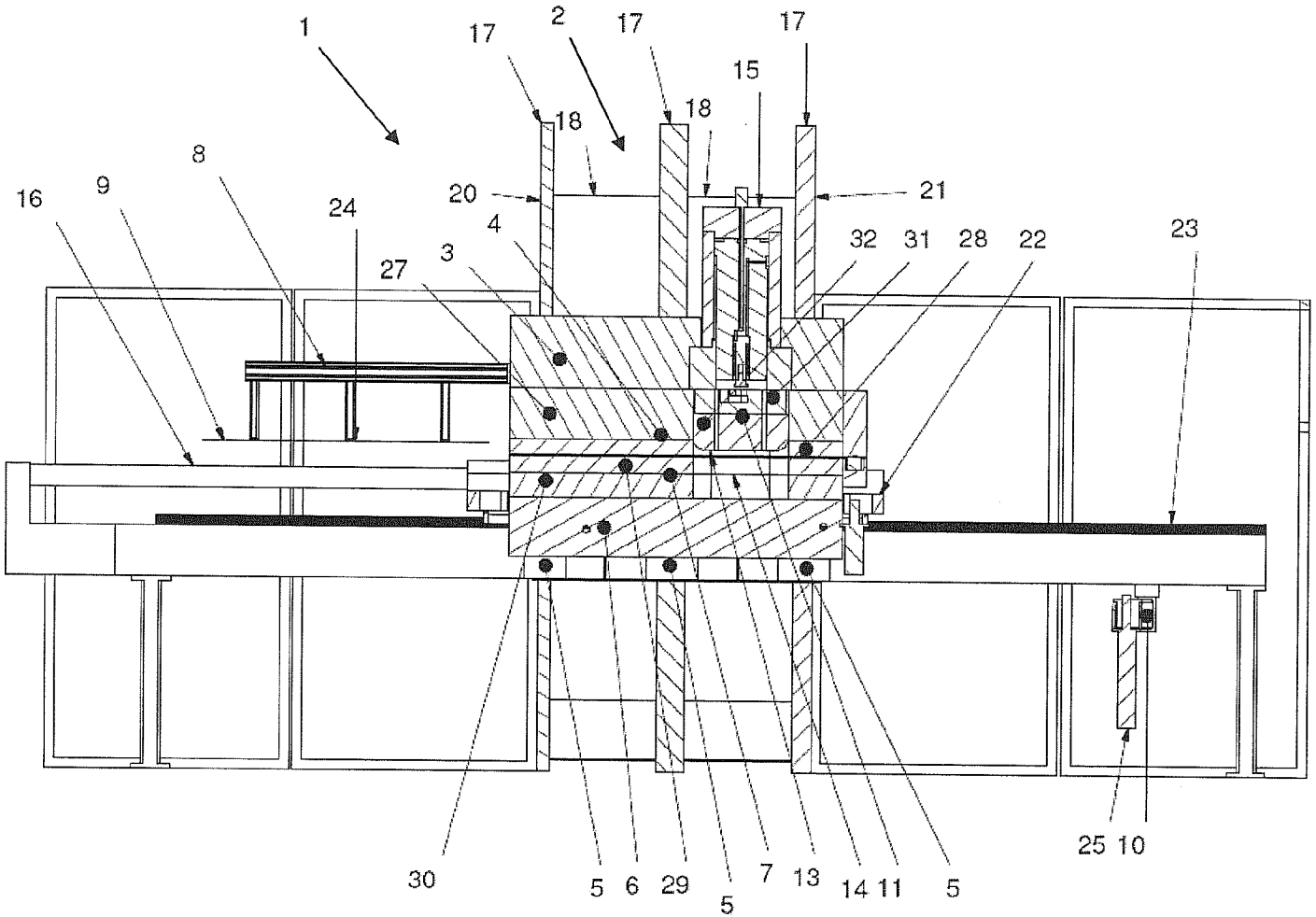
FIG. 12 shows a cross-section of a press in a fourth embodiment.

FIG. 12 shows a cross-section of a press in a fourth embodiment where the first press bed 3 with the first tool part 4 is arranged above the second press bed 6 with the second tool part 7. The first displacement means 5 are connected between the frame 2 and the second press bed 6. The second tool part 7 can be displaced under the action of the second displacement means 16 between a loading position (not shown), a pressing position and an ejection position (not shown). On FIG. 12, the press 1 is shown in the pressing position. The skilled in the art will be able to derive the not shown positions on the basis of FIG. 12 combined with FIG. 9 for the loading position and FIG. 11 for the ejecting position, respectively.

Figure 13:
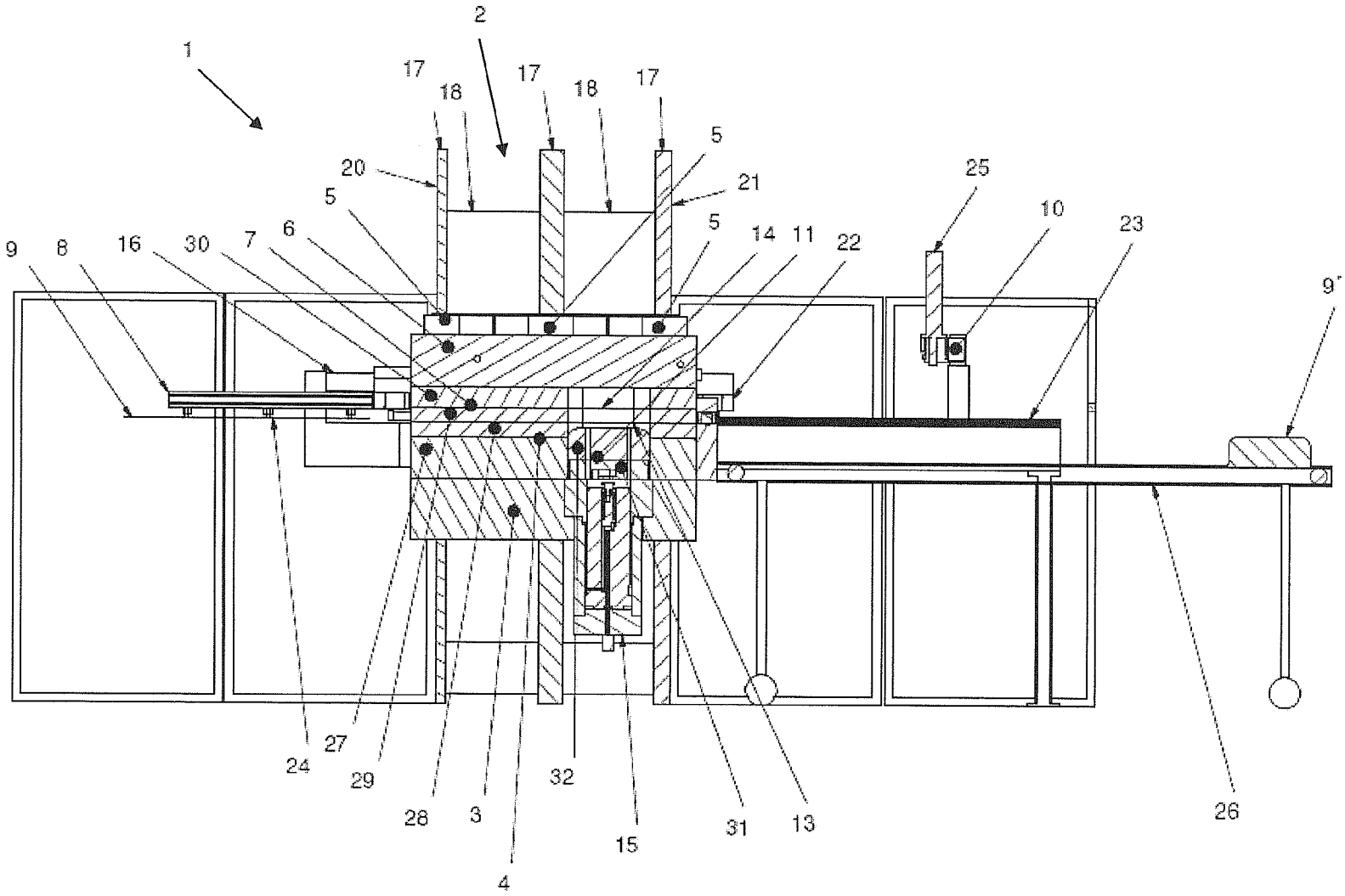
FIG. 13 shows a cross-section of a press in a fifth embodiment.

FIG. 13 shows a cross-section of a press in a fifth embodiment where the first press bed 3 with the first tool part 4 is arranged under the second press bed 6 with the second tool part 7. The first displacement means 5 are connected between the frame 2 and the second press bed 6. The device 8 for introducing workpieces 9 is connected to the second tool part 7. When the second tool part 7 is displaced to the ejection position (not shown) under the action of the second displacement means 16, the device 8 follows for introducing workpieces into the press 1 for placing a workpiece on the first tool part 4. The skilled in the art will be able to derive the not shown position on the basis of FIG. 13 combined with FIG. 4.

REFERENCE NUMBER FOR FIGURES

1 Press
2 frame
3 first press bed
4 first tool part
5 first displacement means
6 second press bed
7 second tool part
8 a device for introducing workpieces;
9 workpieces
9' finished workpieces
10 a device for ejecting finished workpieces;
11 a punch
11' an additional punch
13 coaxial opening in the first tool part
13' additional coaxial opening in the first tool part
14 coaxial opening in the second tool part
14' additional coaxial opening in the second tool part
15 a punch cylinder
15' an additional punch cylinder
16 second displacement means;
17 side members
18 frame members
19 through-going opening in the frame
20 one opposing side of the press
21 other opposing side of the press
22 slide
23 guides
24 suction discs
25 ejector cylinder
26 conveyor belt
27 first base plate
28 blank holder
29 draw ring
30 second base plate
31 third base plate
32 forming piston

The invention claimed is:

1. A press (1) including:

a frame (2);

a first press bed (3) with a first tool part (4), wherein the first press bed (3) is provided between the frame (2) and the first tool part (4);

first displacement means (5);

a second press bed (6) with a second tool part (7) which in use is arranged at a position opposite to the first tool part (4), and where the second press bed (6) is provided between the frame (2) and the second tool part (7);

a device (8) for introducing workpieces (9) between the first (4) and the second tool parts (7);

a device (10) for ejecting finished workpieces (9');

a punch (11) which is vertically displaceable through coaxial openings (13, 14) between the first tool part (4) and the second tool part (7);

a punch cylinder (15) for displacing the punch (11), wherein it furthermore includes second displacement means (16) which are connected between the frame (2) and the second tool part (7) for horizontal displacement of the second tool part (7) between a pressing position with the openings (13, 14) aligned, and an ejecting position with the opening (14) of the second tool part outside the press beds (3, 6), and that the first displacement means (5) are connected between the frame (2) and the first press bed (3), where the first press bed (3) is vertically displaceable, and where the second press bed (6) is fastened to the frame (2), or that the first displacement means (5) are connected between the frame (2) and the second press bed (6), where the second press bed (6) is vertically displaceable, and where the first press bed (3) is fastened to the frame (2).

2. Press according to claim 1, wherein the punch cylinder (15) is connected between the first press bed (3) and the punch (11).

3. Press according to claim 1, wherein the first tool part (4) is arranged at a position under the second tool part (7).

4. Press according to claim 1, wherein the first tool part (4) is arranged at a position above the second tool part (7).

5. Press according to claim 1, wherein the first displacement means (5) are hydraulic cylinders.

6. Press according to claim 1, wherein the first displacement means (5) are hydraulic membranes.

7. Press according to claim 1, wherein that it furthermore includes:

at least one additional punch (11') which is vertically displaceable through additional coaxial openings (13', 14') between the first tool part (4) and the second tool part (7);

an additional punch cylinder (15') for displacing the at least one additional punch (11').

8. Press according to claim 1, wherein the second displacement means (16) are adapted for horizontal displacement of the second tool part (7) between the pressing position with the openings (13, 14) aligned and a loading position with the opening (14) of the second tool part outside the press beds (3, 6).

9. A method for operating a press, the press including:

a frame (2)

a first press bed (3) with a first tool part (4), wherein the first press bed (3) is provided between the frame and the first tool part (4);

first displacement means (5);

a second press bed (6) with a second tool part (7) which in use is arranged at a position opposite to the first tool part (4), and where the second press bed (6) is provided between the frame (2) and the second tool part (7);

a device (8) for introducing workpieces (9) between the first (4) and the second tool parts (7);

a device (10) for ejecting finished workpieces (9');

a punch (11) which is vertically displaceable through coaxial openings (13, 14) between the first tool part (4) and the second tool part (7);

a punch cylinder (15) for displacing the punch (11);

wherein the method includes the steps:

a workpiece (9) is introduced in the press (1) by using the device (8) for introducing workpieces (9);

the first press bed (3) or the second press bed (6) is displaced vertically to a pressing position of the press by using the first displacement means (5) connected between the frame and the press bed (3, 6);

the workpiece is formed by moving the punch (11) through a working stroke from a first position where the punch is outside the opening (14) in the second tool part (7) to a second position where the punch is within the opening (14) in the second tool part (7) by using the punch cylinder (15);

the punch (11) is returned to the first position;

the workpiece (9') is ejected by using the device (10) for ejecting finished workpieces (9'), wherein second displacement means (16) are provided connected between the frame (2) and the second tool part (7) for horizontal displacement of the second tool part (7), that the second tool part (7) is displaced horizontally between the pressing position, where the openings are aligned, and an ejection position, where the opening (14) of the second tool part is disposed outside the press beds (3, 6) by using the second displacement means (16).

10. Method for operating a press according to claim 7, wherein the speed of the punch (11) and the speed of the additional punch (11') are controlled such that the relative position of the individual punch (11, 11') relative to the full working stroke of the individual punch is the same for the punchs (11, 11') during the entire working stroke.

11. Method according to claim 8, wherein the workpiece introducing step is performed approximately at the same time as the workpiece ejecting step.

12. Method according to claim 8, wherein the workpiece introducing step includes additional steps, during which the second tool part (7) is displaced horizontally to a loading position by using the second displacement means (16), where the opening (14) of the second tool part is disposed outside the press beds (3, 6);

the workpiece is placed on the second tool part by using the device (8) for inserting workpieces (9);

the second tool part (7) is displaced horizontally to the pressing position by using the second displacement means (16), where the openings (13, 14) are aligned.

* * * * *

UNITED STATES PATENT AND TRADEMARK OFFICE

CERTIFICATE OF CORRECTION

PATENT NO. : 8,881,570 B2
APPLICATION NO. : 13/125093
DATED : November 11, 2014
INVENTOR(S) : Martin Hansen It is certified that error appears in the above-identified patent and that said Letters Patent is hereby corrected as shown below:

In the Specification:

Column 1, line 5, change "DK2998.959263" to --2009/050273--.

Signed and Sealed this
Third Day of March, 2015

Michelle K. Lee

Michelle K. Lee
*Deputy Director of the United States Patent and Trademark Office*